US005469124A

United States Patent [19]

O' Donnell et al.

[11] Patent Number: 5,469,124

[45] Date of Patent: Nov. 21, 1995

[54] HEAT DISSIPATING TRANSFORMER COIL

[75] Inventors: Patricia A. O' Donnell, Davidsonville; Charles S. Kerfoot, Pasadena; Joseph J. Springer, Bel Air, all of Md.

[73] Assignee: Westinghouse Electric Corp., Baltimore, Md.

[21] Appl. No.: 258,141

[22] Filed: Jun. 10, 1994

[51] Int. Cl.[6] ..... H01F 27/10; H01F 27/26

[52] U.S. Cl. ..... 336/61; 336/65; 336/210

[58] Field of Search ..... 336/61, 55, 210, 336/65, 198

[56] References Cited

U.S. PATENT DOCUMENTS

| | | | |
|---|---|---|---|
| 1,608,891 | 11/1926 | Lee | 336/61 |
| 2,770,785 | 11/1956 | Haagens et al. | 336/61 |
| 2,903,661 | 9/1959 | Goffstein | 336/65 |
| 3,160,837 | 12/1964 | Jones | 336/61 |
| 3,428,928 | 2/1969 | Maines | 336/61 |
| 3,883,834 | 5/1975 | Osteen | 336/61 |
| 3,984,756 | 10/1976 | Korotkov et al. | 336/61 |

FOREIGN PATENT DOCUMENTS

| | | | |
|---|---|---|---|
| 1580263 | 7/1969 | France | 336/61 |
| 4-209509 | 7/1992 | Japan | 336/61 |

*Primary Examiner*—Thomas J. Kozma
*Attorney, Agent, or Firm*—Walter G. Sutcliff

[57] ABSTRACT

An easy to assemble transformer for use in an electronics module of an electric vehicle. The transformer can be assembled from the "top down," thus alleviating the need to build the transformer as a subassembly unit. During manufacture of the transformer, windings are wound onto a thermally conductive coil form. Next upper and lower E-shaped core members are inserted into openings in the top and bottom of the form so that the side legs and the center legs of the E's touch and are in alignment. The thermally conductive coil form has a portion that touches a cold plate when the transformer is mounted on the cold plate. The transformer is further secured to the cold plate by a mounting bracket.

17 Claims, 6 Drawing Sheets

HEAT DISSIPATING TRANSFORMER COIL

RELATED APPLICATIONS

The following identified U.S. patent applications are filed on the same date as the instant application and are relied upon and incorporated by reference in this application.

- U.S. patent application entitled "Flat Topping Concept" bearing attorney docket No. 58,295, and filed on the same date herewith;
- U.S. patent application entitled "Electric Induction Motor And Related Method Of Cooling" bearing attorney docket No. 58,332, and filed on the same date herewith;
- U.S. patent application entitled "Automotive 12 Volt System For Electric Vehicles" bearing attorney docket No. 58,333, and filed on the same date herewith;
- U.S. patent application entitled "Direct Cooled Switching Module For Electric Vehicle Propulsion System" bearing attorney docket No. 58,334, and filed on the same date herewith;
- U.S. patent application entitled "Electric Vehicle Propulsion System" bearing attorney docket No. 58,335, and filed on the same date herewith;
- U.S. patent application entitled "Speed Control and Bootstrap Technique For High Voltage Motor Control" bearing attorney docket No. 58,336, and filed on the same date herewith;
- U.S. patent application entitled "Vector Control Board For An Electric Vehicle Propulsion System Motor Controller" bearing attorney docket No. 58,337, and filed on the same date herewith;
- U.S. patent application entitled "Digital Pulse Width Modulator With Integrated Test And Control" bearing attorney docket No. 58,338, and filed on the same date herewith;
- U.S. patent application entitled "Control Mechanism For Electric Vehicle" bearing attorney docket No. 58,339, and filed on the same date herewith;
- U.S. patent application entitled "Improved EMI Filter Topology for Power Inverters" bearing attorney docket No. 58,340, and filed on the same date herewith;
- U.S. patent application entitled "Fault Detection Circuit For Sensing Leakage Currents Between Power Source And Chassis" bearing attorney docket No. 58,341, and filed on the same date herewith;
- U.S. patent application entitled "Electric Vehicle Relay Assembly" bearing attorney docket No. 58,342, and filed on the same date herewith;
- U.S. patent application entitled "Three Phase Power Bridge Assembly" bearing attorney docket No. 58,343, and filed on the same date herewith;
- U.S. patent application entitled "Electric Vehicle Propulsion System Power Bridge With Built-In-Test" bearing attorney docket No. 58,344, and filed on the same date herewith;
- U.S. patent application entitled "Method For Testing A Power Bridge For An Electric Vehicle Propulsion System" bearing attorney docket No. 58,345, and filed on the same date herewith;
- U.S. patent application entitled "Electric Vehicle Power Distribution Module" bearing attorney docket No. 58,346, and filed on the same date herewith;
- U.S. patent application entitled "Electric Vehicle Chassis Controller" bearing attorney docket No. 58,347, and filed on the same date herewith;
- U.S. patent application entitled "Electric Vehicle System Control Unit Housing" bearing attorney docket No. 58,348, and filed on the same date herewith;
- U.S. patent application entitled "Low Cost Fluid Cooled Housing For Electric Vehicle System Control Unit" bearing attorney docket No. 58,349, and filed on the same date herewith;
- U.S. patent application entitled "Electric Vehicle Coolant Pump Assembly" bearing attorney docket No. 58,350, and filed on the same date herewith;
- U.S. patent application entitled "Electric Vehicle Battery Charger" bearing attorney docket No. 58,352, and filed on the same date herewith.

BACKGROUND OF THE INVENTION

This application relates to a transformer, and more specifically, to a transformer used in an electronics module of an electric vehicle.

For an electric vehicle to be commercially viable, its cost and performance should be competitive with that of its gasoline-powered counterparts. Typically, the vehicle's propulsion system and battery are the main factors which contribute to the vehicle's cost and performance competitiveness.

Generally, to achieve commercial acceptance, an electric vehicle propulsion system should provide the following features: (1) vehicle performance equivalent to typical gasoline-powered propulsion systems; (2) smooth control of vehicle propulsion; (3) regenerative braking; (4) high efficiency; (5) low cost; (6) self-cooling; (7) electromagnetic interference (EMI) containment; (8) fault detection and self-protection; (9) self-test and diagnostics capability; (10) control and status interfaces with external systems; (11) safe operation and maintenance; (12) flexible battery charging capability; and (13) auxiliary 12 volt power from the main battery. In prior practice, however, electric vehicle propulsion system design consisted largely of matching a motor and controller with a set of vehicle performance goals, such that performance was often sacrificed to permit a practical motor and controller design. Further, little attention was given to the foregoing features that enhance commercial acceptance.

For example, a typical conventional electric vehicle propulsion system consisted of a DC motor, a chopper-type motor controller, an independent battery charger, and a distributed set of controls and status indicators. Vehicle performance was generally inadequate for highway driving, acceleration was uneven, and manual gear-changes were required. In addition, regenerative braking was either not available or, at best, available only at high motor speeds. Also, each of the system components had its own cooling system that used forced air or a combination of forced air and liquid cooling. Moreover, the issues of volume production cost, EMI, fault detection, maintenance, control and status interfaces, and safety were generally not addressed in a comprehensive manner.

Electric vehicles often include an electronics module, such as a DC/DC converter, that includes a transformer. Transformers of a type suitable for use in electronic vehicles usually include a "core" and some type of "winding" surrounding the core. Generally, a transformer should be able to dissipate thermal energy from the windings. In addition, the transformer should be easy and inexpensive to manufacture.

Conventional transformers are assembled as a subassembly unit, after which the subassembly unit is added to a larger electronics module. During assembly of a conventional transformer subassembly unit, two E-shaped core members are first placed so that the "legs" of the E's touch and are in alignment. Next a wire "winding" is wound around a center leg of the core members. A steel band is placed around the entire subassembly, either before or after the winding step, to secure the core members together.

Assembling such a transformer subassembly is time consuming. Furthermore, the subassembly must be assembled separately before it can be added to the main electronics module. In addition, it is difficult to perform the winding step because the winding material must be threaded through the legs of the core members.

After assembly, some transformer subassemblies are mounted to a mounting surface by placing the subassembly parallel to the mounting surface and covering both the subassembly and the mounting surface with potting compounds. In other instances, the transformers subassembly is bolted to the mounting surface. Conventional transformer subassembly units may be surrounded by steel bands or some other means of holding the subassembly together.

SUMMARY OF THE INVENTION

The present invention overcomes the problems and disadvantages of the prior art by incorporating a transformer that does not need to be assembled as a subassembly. In the present invention the windings are first wound onto a thermally conductive coil form and center legs of the core members are then inserted into the coil form. The coil form includes a portion that can be placed in thermal contact with a mounting surface that is also a heat sink so that thermal energy from the windings is transferred through the coil form to the mounting surface. A mounting bracket secures the core members and the coil form to the mounting surface.

In accordance with the purpose of the invention, as embodied and broadly described herein, the invention is a transformer for use in an electric vehicle electronics module that includes a cold plate, comprising: a hollow coil form of thermally conductive material, having two open ends; windings wrapped around the coil form in thermal contact with the coil form; a lower E-core inserted in a first open end of the coil form; an upper E-core inserted in a second open end of the coil form, so that the upper and lower E-cores are in alignment; and means for connecting the coil form in thermal contact with the cold plate so that the coil form provides a thermal path from the windings to the cold plate.

Objects and advantages of the invention will be set forth in part in the description which follows and in part will be obvious from the description or may be learned by practice of the invention. The objects and advantages of the invention will be realized and attained by means of the elements and combinations particularly pointed out in the appended claims.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

DETAILED DESCRIPTION OF A PREFERRED EMBODIMENT

Reference will now be made in detail to a preferred embodiment of the invention, examples of which is illustrated in the accompanying drawings. Wherever possible, the same reference numbers will be used throughout the drawings to refer to the same or like parts.

Figure 1:
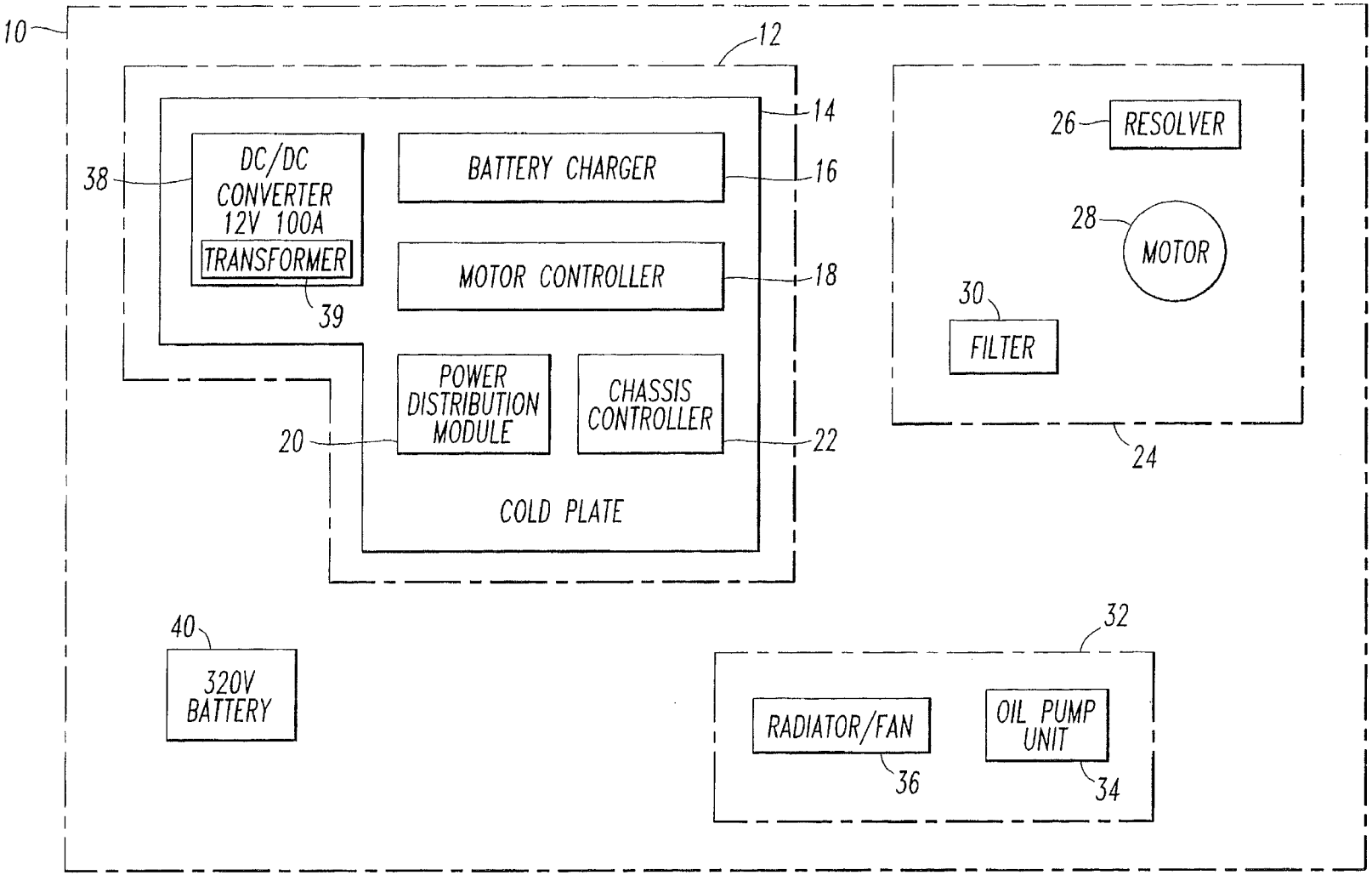
FIG. 1 is a block diagram of an electric vehicle propulsion system in accordance with a preferred embodiment of the invention.

As shown in FIG. 1, there is provided an electric vehicle propulsion system 10 comprising a system control unit 12, a motor assembly 24, a cooling system 32, a battery 40, and a DC/DC converter 38. The DC/DC converter 38 includes a transformer 39. The system control unit 12 and the transformer 39 of the DC/DC converter 38 contact a cold plate 14. The system control unit 12 includes a battery charger 16, a motor controller 18, a power distribution module 20, and a chassis controller 22. The motor assembly 24 includes a resolver 26, a motor 28, and a filter 30. The cooling system 32 includes an oil pump unit 34 and a radiator/fan 36. In other versions of the system, the transformer 39 of the DC/DC converter 38 does not contact cold plate 14.

Figure 2:
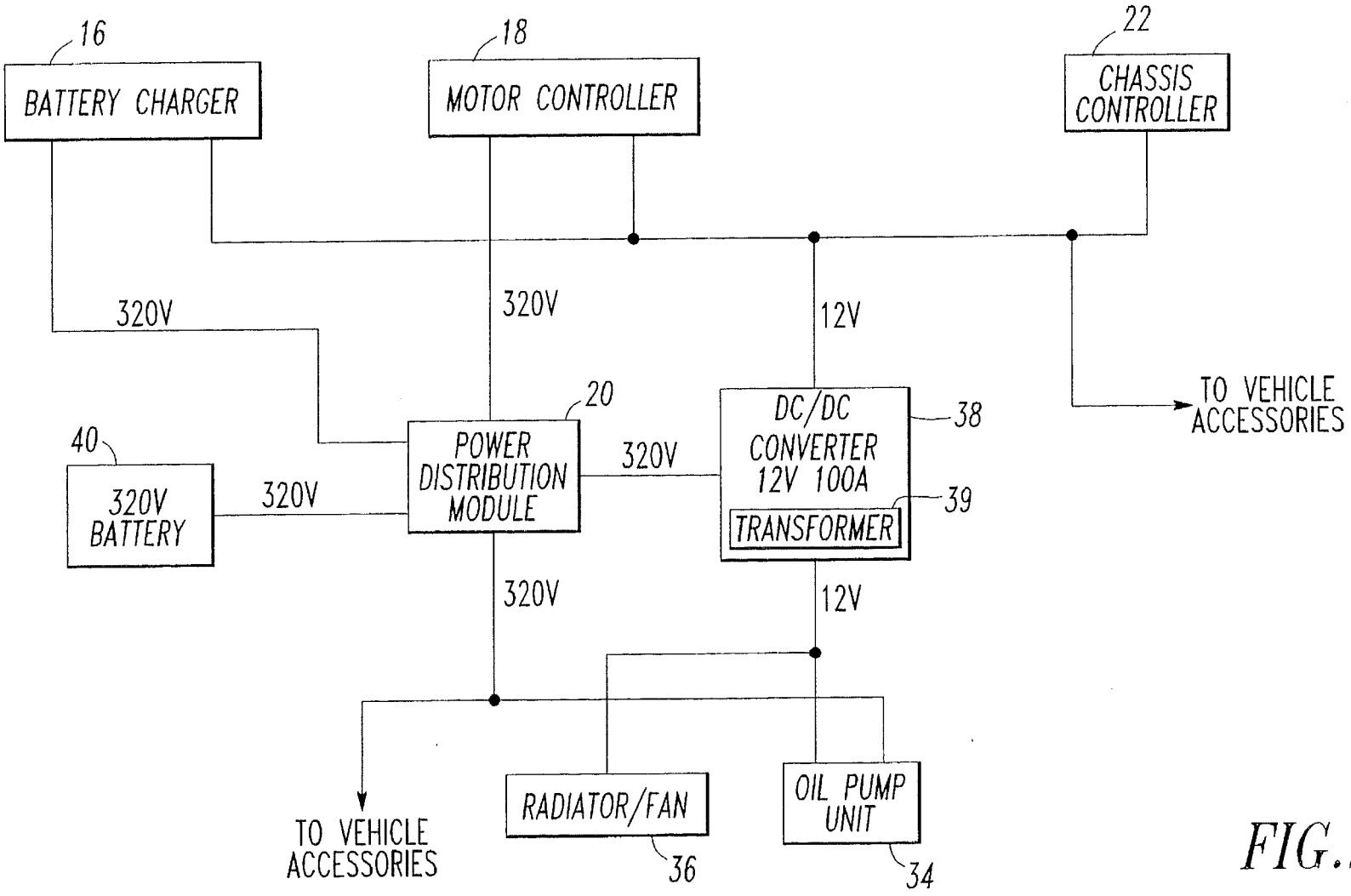
FIG. 2 is a power distribution diagram of the electric vehicle propulsion system of FIG. 1.

FIG. 2 is a power distribution diagram of the electric vehicle propulsion system 10. As shown in FIG. 2, the battery 40 serves as the primary source of power for the electric propulsion system 10. The battery 40 comprises, for example, a sealed lead acid battery, a monopolar lithium metal sulfide battery, a bipolar lithium metal sulfide battery, or the like, for providing a 320 volt output. Preferably, the electric propulsion system 10 works over a wide voltage range, e.g., 120 volts to 400 volts, to accommodate changes in the output voltage of the battery 40 due to load or depth of discharge. However, the electric vehicle propulsion system 10 is preferably optimized for nominal battery voltages of about 320 volts.

The power distribution module 20 is coupled to the output of the battery 40 and includes, among other things, fuses, wiring, and connectors for distributing the 320 volt output from the battery 40 to various components of the electric vehicle propulsion system 10. For example, the power distribution module 20 distributes the 320 volt output from the battery 40 to the motor controller 18, the DC/DC converter 38, the oil pump unit 34, and the battery charger 16. The power distribution module 20 also distributes the 320 volt output from the battery 40 to various vehicle accessories, which are external to the electric vehicle propulsion system 10. These vehicle accessories include, for example, an air conditioning system, a heating system, a power steering system, and any other accessories that may require a 320 volt power supply.

The DC/DC converter 38, which, as described above, is coupled to the 320 volt output of the power distribution module 20, converts the 320 volt output of the power distribution module 20 to 12 volts. The DC/DC converter 38 then supplies its 12 volt output as operating power to the battery charger 16, the motor controller 18, the chassis controller 22, and the oil pump unit 34 and the radiator fan 36. The DC/DC converter 38 also supplies its 12 volt output as operating power to various vehicle accessories, which are external to the electric vehicle propulsion system 10. These vehicle accessories include, for example, vehicle lighting, an audio system, and any other accessories that may require a 12 volt power supply. It should be appreciated that the DC/DC converter 38 eliminates the need for a separate 12 volt storage battery.

Figure 3:
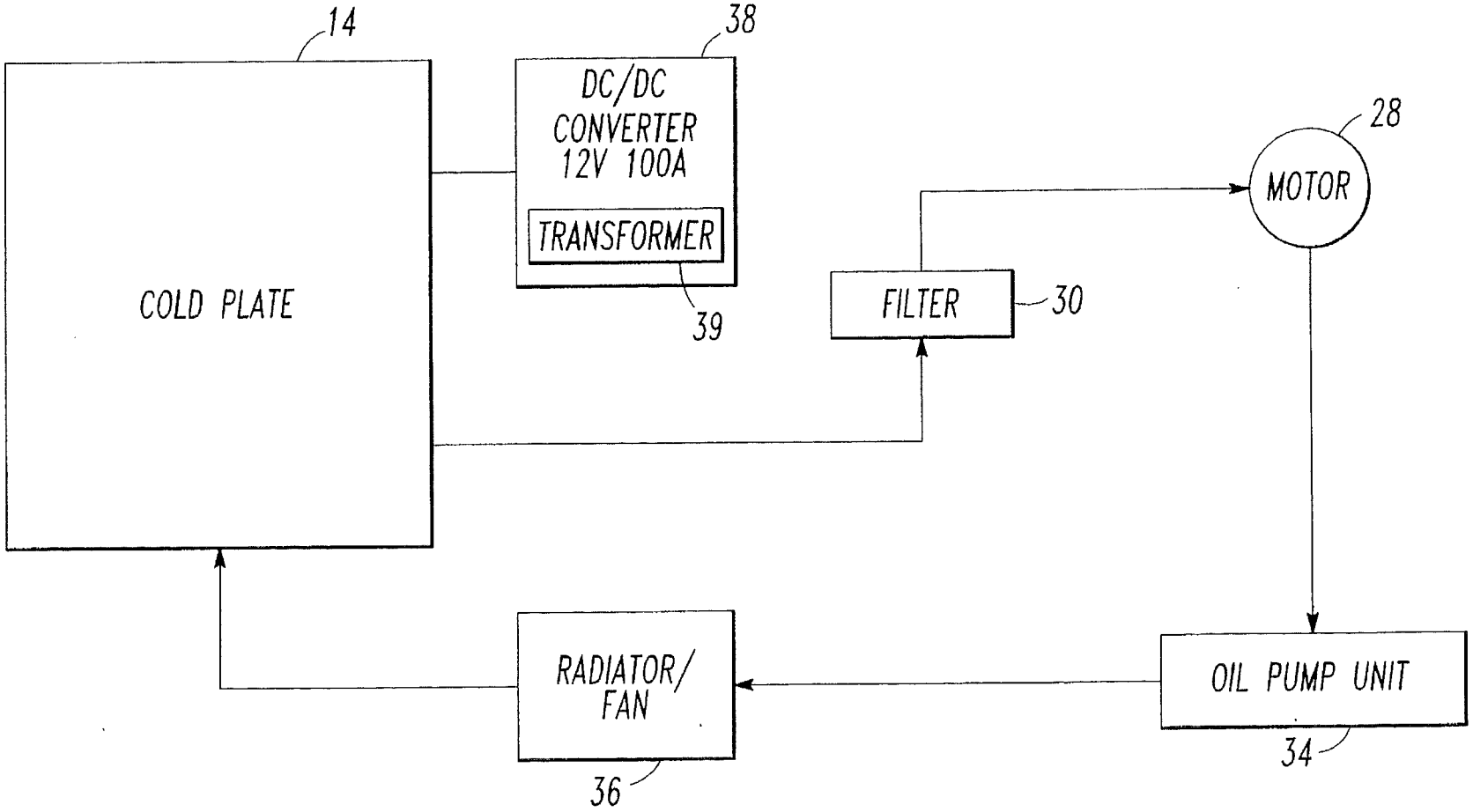
FIG. 3 is a cooling diagram of the electric vehicle propulsion system of FIG. 1.

As shown in FIG. 3, the electric vehicle propulsion system 10 utilizes a closed loop cooling system including the cold plate 14, the filter 30, the motor 28, the oil pump unit 34, and the radiator/fan 36. Preferably, the cold plate 14 is a hollow body having a double-sided surface on which the battery charger 16, the motor controller 18, the power distribution module 20, and the chassis controller 22 are mounted in thermal contact. It is contemplated that the transformer 39 of the DC/DC converter 38 is mounted in thermal contact on the cold plate 14 as described below in connection with FIGS. 4–7. The oil pump unit 34 circulates oil, e.g., aircraft turbine oil, from the oil reservoir of the motor 28 through the radiator/fan 36, the cold plate 14, the filter 30, and back through the motor 28 as shown in FIG. 3. Heat is removed from the oil by the radiator/fan 36 and the oil is filtered by the filter 30, which can comprise a commercially available oil filter known in art. Preferably, the oil pump unit 34 is controlled by the motor controller 18 to provide a variable rate of oil flow.

It should be appreciated that the closed loop oil cooling system of FIG. 3 protects the electric vehicle propulsion system 10 from the harsh automotive operating environment, thus increasing reliability and reducing maintenance. Further, because the same oil used for lubricating the motor 28 is also used for cooling of the system control unit 12, the cooling system can have a simplified design.

The following paragraphs describe a preferred embodiment of the present invention and a preferred method for assembling a transformer in accordance with the invention.

Figure 4:
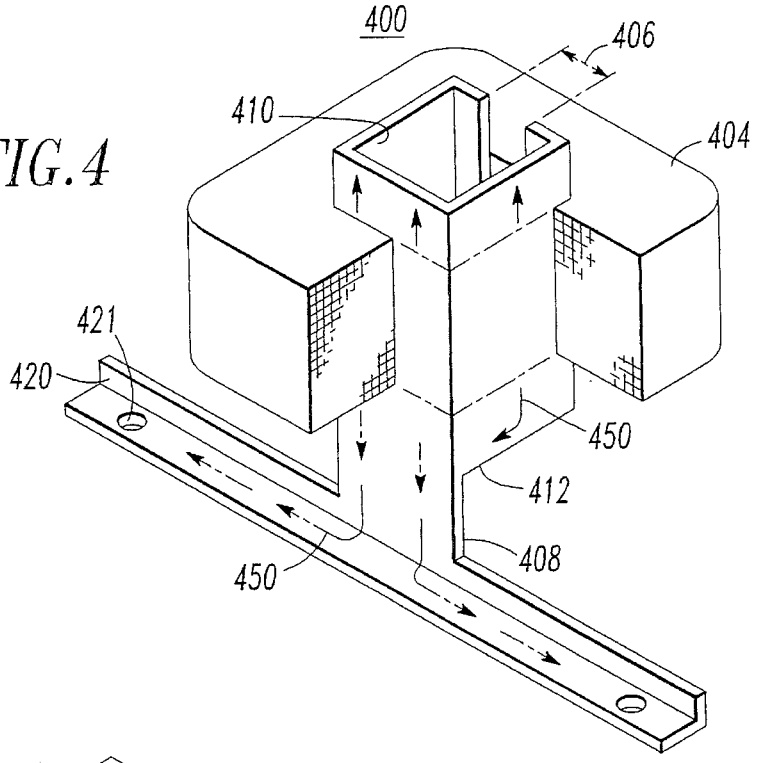
FIG. 4 is a diagram of a coil form according to a preferred embodiment of the present invention.

FIG. 4 is a diagram of a coil form 400 according to a preferred embodiment of the present invention. The coil form 400 is included in the transformer 39, which is included in an electronics module, such as the DC/DC converter 38. The coil form 400 is formed of thermally conductive material, such as aluminum, and has an open top end 410 and an open bottom end 412. Windings 404 are wound on the coil form 400 so that the windings 404 are in thermal contact with the coil form 400. Only part of the windings 404 are shown in FIG. 4 to aid in explanation of the coil form. Coil form 400 includes an open side having a gap 406, which prevents formation of a shorted turn. A protruding portion 408 of coil form 400 extends downward and ends in a flange 420. The flange 420 has two holes 421. In the described embodiment, the flange 420 is formed integrally with the coil form 400. In another preferred embodiment the flange 420 is formed separately and mounted onto the coil form 400. A path of thermal energy during operation is indicated in FIG. 4 by arrows 450.

Figure 5:
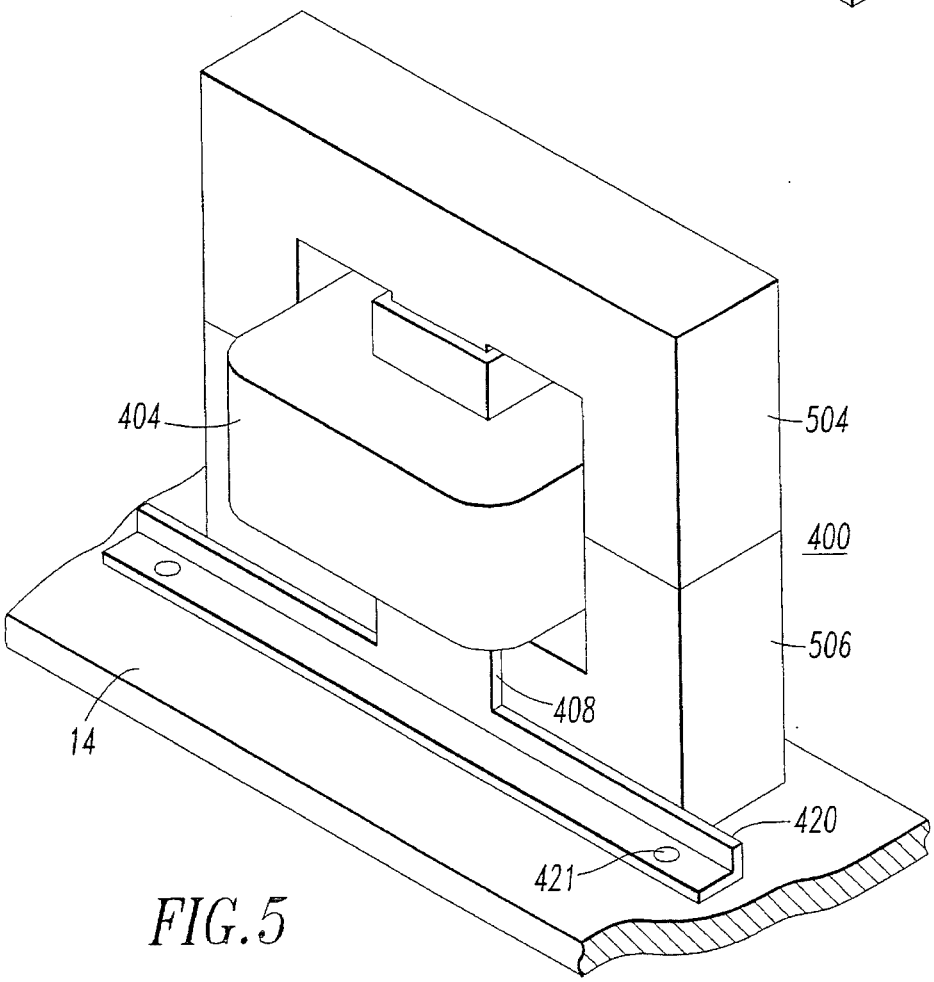
FIG. 5 is a diagram of a transformer including core members and the coil form of FIG. 4 mounted on a cold plate.

FIG. 5 is a diagram of the transformer, including an upper core member 504 and a lower core member 506 and the coil form 400 of FIG. 4, mounted on the cold plate 14. Upper and lower core members 504 and 506 are E-shaped core members (E-cores) having two side legs and, respectively, a descending center leg and an ascending center leg. In FIG. 5, the side legs and the ascending and descending center legs of the upper and lower core members 504 and 506 are touching and in alignment. The aligned core members together total approximately 4 inches in height. Each core member is approximately 3 inches in width and approximately ¾ inches deep. In another preferred embodiment, each core member 504 and 506 is formed of stacked or laminated plates in a manner known to persons of ordinary skill in the art.

The coil form 400 provides a thermal path from the windings 404 to the cold plate 14. Specifically, thermal energy travels through the coil form 400 in the directions of the arrows of FIG. 4 and is transferred to the cold plate 14 through the protruding portion 408, which covers a part of a front side of the lower core member 506, to the flange 420.

Figure 6:
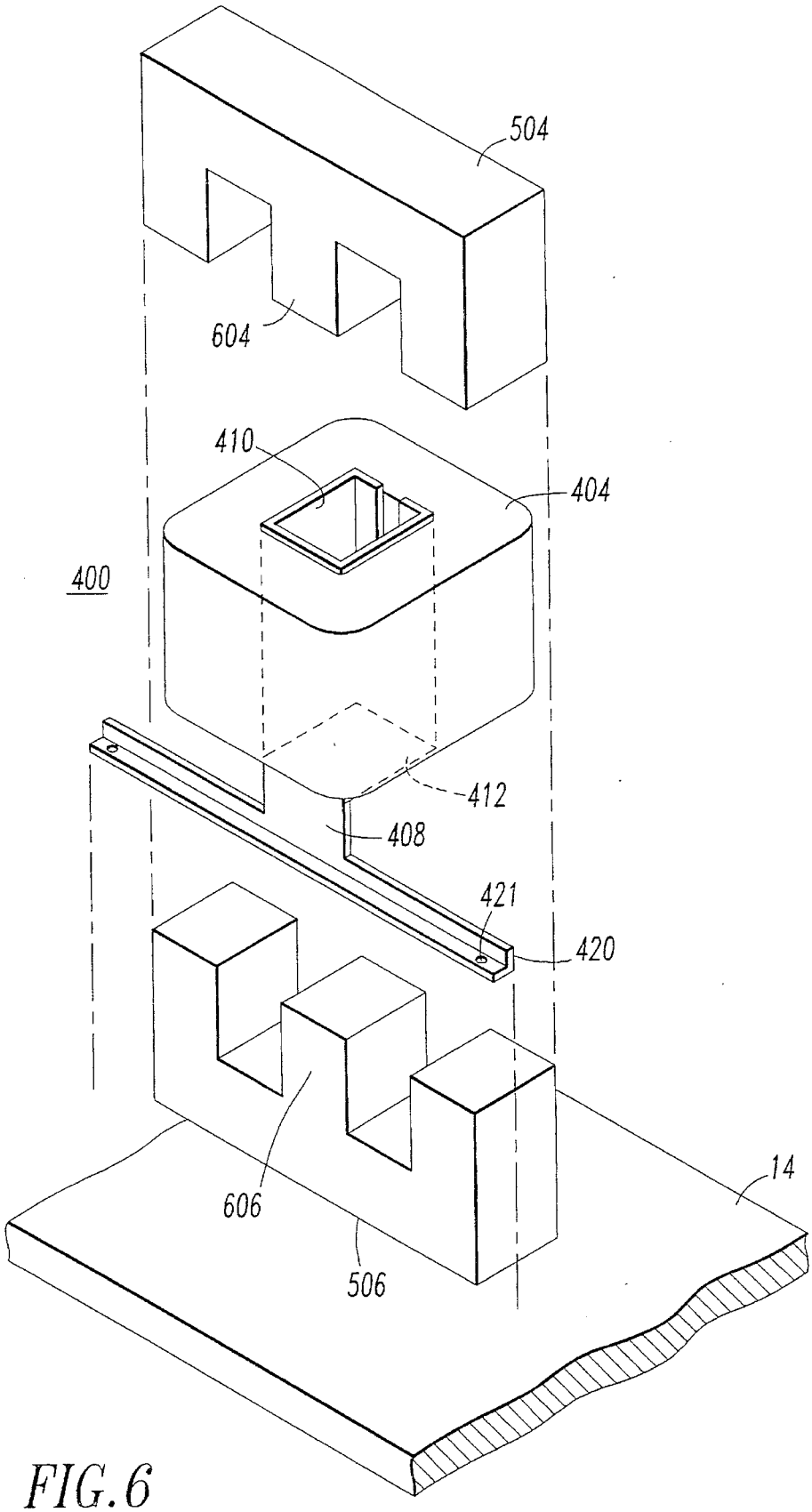
FIG. 6 is an exploded view of the transformer of FIG. 5.

FIG. 6 is an exploded view of the transformer of FIG. 5. During assembly of the transformer, the lower core member 506 is placed on the cold plate 14. Next, the coil form 400 is placed in a vertical orientation over the ascending center leg 606 of lower core member 506 so that the first open end 412 of the coil form fits over the ascending center leg 606 of the lower core member 506 and establishes a low thermal impedance connection between the coil form 400 and the cold plate. Next, the upper core member 504 is placed on the lower core member 506 so that the second open end 410 of the coil form 400 fits over the descending center leg 604 of the upper core member 504, thereby aligning the side legs and the ascending and descending center legs of the upper and lower core members 504 and 506.

The windings 404 preferably are wound onto the coil form 400 prior to the step of placing the upper core member 504. Thus, e.g., the windings 404 may be wound onto the coil form 400 before the coil form 400 is placed on the lower core member 506 or after the coil form 400 is placed on the lower core member 506 (but before the upper core member 504 is placed).

Figure 7:
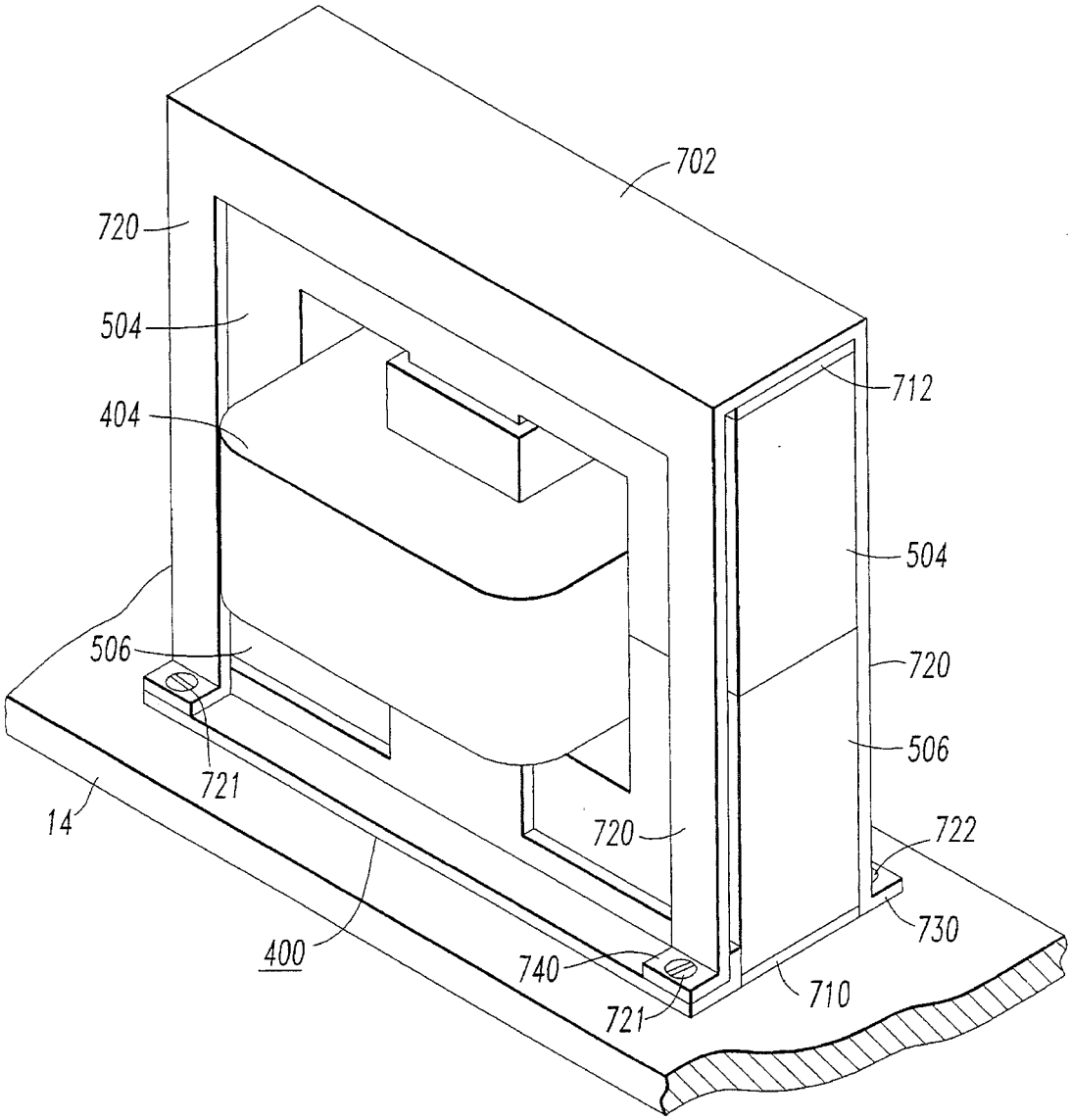
FIG. 7 is a diagram of a mounting bracket securing the transformer of FIG. 5 to the cold plate.

FIG. 7 is a diagram of a mounting bracket 702 securing the transformer of FIG. 5 to the cold plate 14. After the upper and lower core members 504 and 506 and the coil form 400 are placed, the mounting bracket 702 is placed over the core members 504 and 506 and the coil form 400 to secure the core members and the coil form to the cold plate 14. The mounting bracket 702 includes one or more holes 721 that correspond to the holes 421 in the coil form 400. Screws or other suitable fasteners are inserted through the holes 721 and 421 to secure the upper and lower core members and the coil form in place on the cold plate. The mounting bracket 702 also contains holes 722 on a back flange 730 of the mounting bracket 702. In the described embodiment, the back flange 730 extends slightly lower than a front flange 740 because coil form 400 does not have a flange in the back. In another preferred embodiment, the mounting bracket 702 may also include legs extending along the sides of the core members 504 and 506.

The mounting bracket 702 may or may not be thermally conductive. In a preferred embodiment, the mounting bracket 702 is formed of aluminum, which is thermally conductive, and which aids somewhat in conducting heat away from the cores. In FIG. 7, the mounting bracket is approximately 30 mil thick. Each of four legs 720 is preferably approximately 3/10 of an inch wide.

In the embodiment of FIG. 7, a layer of thermally conductive compressible material 710, such as T274 (Chomerics material), is located between the bottom of the lower core member 506 and the top of the cold plate 14. The thermally conductive compressible material 710 helps keep the lower core member 506 in place and prevents it from slipping or chipping. The embodiment of FIG. 7 also includes a layer of thermally conductive compressible material 712 located between the top of the upper core member 504 and the bottom of the mounting bracket 702. The thermally conductive compressible material 712 also helps keep the upper core member 504 in place and prevents it from slipping or chipping. During manufacture of the transformer, the material 710 is placed on the cold plate before the lower core member 506 is placed on the cold plate 14. Similarly, material 712 is placed on the mounting bracket 702 before the assembly process. In another preferred embodiment, materials 710 and 712 may not be thermally conductive or may be omitted altogether.

In summary, the transformer of the present invention may be manufactured using a "top down" assembly process in which all parts are added to the transformer from the top during assembly. This method makes the transformer easy and inexpensive to assemble.

Other embodiments will be apparent to those skilled in the art from consideration of the specification and practice of the invention disclosed herein. It is intended that the specification and examples be considered as exemplary only, with a true scope of the invention being indicated by the following claims.

We claim:

1. A transformer for use in an electric vehicle electronics module, comprising:

a hollow coil form of thermally conductive material, said coil form having an upper portion including two open ends, an intermediate portion, and a base portion;

windings wrapped around the upper portion of the coil form and being in thermal contact therewith;

a lower E-core inserted in a first open end of the upper portion of the coil form;

an upper E-core inserted in a second open end of the upper portion of the coil form, so that the upper and lower E-cores are in mutual alignment;

said intermediate portion protruding from the lower end of said upper portion and extending to said base portion, and including a generally flat core contact surface, said core contact surface covering a portion of a front side of the lower E-core when the lower E-core is inserted in the first open end of the upper portion of the coil form;

said base portion comprising a bifurcated flange member projecting orthogonally outward substantially equidistantly from the lower end of said intermediate portion, thereby connecting the coil form in thermal contact with a cold plate so that the coil form provides a thermal path from the windings to the cold plate.

2. The transformer of claim 1, wherein the coil form is vertically oriented.

3. The transformer of claim 1, wherein the coil form is formed of aluminum.

4. The transformer of claim 1, wherein the upper portion of the coil form has an open side.

5. The transformer of claim 1, wherein the flange member is integral with the intermediate portion of the coil form.

6. The transformer of claim 1, further including means for fastening the flange member to the intermediate portion of the coil form.

7. The transformer of claim 1, further comprising a layer of compressible material between the lower E-core and the cold plate.

8. The transformer of claim 7, wherein the compressible material is thermally conductive.

9. The transformer of claim 1, further comprising a mounting bracket surrounding the upper and lower E-cores and the coil form for securing the upper and lower E-cores and the coil form in place on the cold plate.

10. The transformer of claim 9, further comprising a layer of compressible material located between the upper E-core and the mounting bracket.

11. The transformer of claim 10, wherein the compressible material is thermally conductive.

12. A coil member for use in an electric vehicle electronics module, comprising:

a hollow coil form of thermally conductive material and comprising an upper end portion including two open ends, an intermediate portion, and a base portion;

windings wrapped around the upper end portion of the coil form and being in thermal contact with the coil form;

said intermediate portion comprising a generally flat core contact surface protruding from the lower end of said upper portion and extending to said base portion;

said base portion comprising a flange consisting of two arms extending outwardly in opposite directions from the lower end of said intermediate portion at substantially right angles, thereby connecting the coil form in thermal contact with a cold plate so that the coil form provides a thermal path from the windings to the cold plate.

13. The coil member of claim 12, wherein the coil form is connectable to the cold plate in a vertical orientation.

14. The coil member of claim 12, wherein the coil form is formed of aluminum.

15. The coil member of claim 12, wherein the upper end portion of the coil form has an open side.

16. The coil member of claim 12, wherein the flange is integral with the intermediate portion of the coil form.

17. The coil member of claim 12, further including means for fastening the flange to the intermediate portion of the coil form.

* * * * *